US005285898A

United States Patent [19]

Zinbarg et al.

[11] Patent Number: 5,285,898

[45] Date of Patent: Feb. 15, 1994

[54] BAT-LIKE DECORATIVE OBJECT

[75] Inventors: Benson E. Zinbarg, 320 Chestnut Hill Rd., Stamford, Conn. 06905; Nancy E. Mimoun, Stamford, Conn.

[73] Assignee: Benson E. Zinbarg, Stamford, Conn.

[21] Appl. No.: 891,648

[22] Filed: May 29, 1992

Related U.S. Application Data

[63] Continuation-in-part of Ser. No. 554,967, Jul. 18, 1990, and a continuation-in-part of Ser. No. 664,023, Mar. 4, 1991, and a continuation-in-part of Ser. No. 664,024, Mar. 4, 1991, and a continuation-in-part of Ser. No. 749,263, Aug. 21, 1991, and a continuation-in-part of Ser. No. 749,165, Aug. 23, 1991, Pat. No. 5,195,638.

[51] Int. Cl.[5] ..... B65D 33/00

[52] U.S. Cl. ..... 206/457; 428/8; 428/16; 446/73; 446/76; 446/228

[58] Field of Search ..... 206/457; 383/37; D9/305, 306, 307, 310; 40/417; 428/7-9, 13, 16, 542.2, 542.6; 446/72-76, 220, 222, 223, 226, 369; D21/160, 169, 185, 186

[56] References Cited

U.S. PATENT DOCUMENTS

| | | | |
|---|---|---|---|
| D. 23,399 | 6/1894 | Lee . | |
| D. 39,516 | 9/1908 | Prugh . | |
| D. 47,064 | 3/1915 | Adams . | |
| D. 49,569 | 8/1916 | Burtchaell . | |
| D. 66,800 | 3/1925 | Lehnert . | |
| D. 74,183 | 1/1928 | McEldowney . | |
| D. 94,174 | 12/1934 | Vogt . | |
| D. 96,425 | 7/1935 | Spanel . | |
| D. 125,195 | 2/1941 | Winsick . | |
| D. 156,059 | 5/1949 | Vivaudou . | |
| D. 164,442 | 9/1951 | Park . | |
| D. 169,265 | 4/1953 | Larezzorio . | |
| 177,749 | 5/1876 | Redden . | |
| D. 183,667 | 10/1958 | Treinis . | |
| D. 186,410 | 10/1959 | Collins . | |
| D. 187,497 | 3/1960 | Goldie . | |
| D. 191,284 | 9/1961 | O'Donnell . | |
| D. 241,819 | 10/1976 | Flecken . | |
| D. 256,826 | 9/1980 | Phillips . | |
| D. 258,205 | 2/1981 | Kroll . | |
| D. 293,959 | 1/1988 | Allen . | |
| D. 310,023 | 8/1990 | Dembiczak et al. . | |
| D. 317,254 | 6/1991 | Dembiczak et al. . | |
| 459,683 | 9/1891 | Fachs | 478/8 X |
| 492,071 | 2/1893 | Vaughan . | |
| 514,159 | 2/1894 | Nelson . | |
| 764,207 | 7/1904 | Robinson . | |
| 795,630 | 7/1905 | Lynn . | |

(List continued on next page.)

FOREIGN PATENT DOCUMENTS

| | | | |
|---|---|---|---|
| 340744 | 5/1904 | France | 446/223 |
| 39851 | 5/1907 | Switzerland . | |
| 379876 | 9/1932 | United Kingdom . | |

OTHER PUBLICATIONS

Dennisons Party Magazine Oct.-Nov. 1927 pp. 19,21,37

*Holiday* A Handbook of Elementary Classroom Ideas to Motivate Teaching . . . by Mary E. Platts, 1978.

Creative Ideas for Christmas 1985 Oxmoor House, Inc. pp. 58-59.

Holiday Gifts, Favors and Decorations Lothrop, Lee & Shepard Co. 1971 pp. 77-79, 82, 83 and 91.

*Primary Examiner*—Bryon P. Gehman

*Attorney, Agent, or Firm*—David P. Gordon

[57] ABSTRACT

Decorative combination structure comprising a combination of a flexible bag member and a flexible sheet which together simulate a fanciful conception of the appearance of a giant bat. The flexible bag is arranged for receiving a plurality of light-weight and preferably inflatable filler elements and for assuming a substantially tubular shape with rounded ends when so filled so as to simulate a bat body, and the bag member is provided with facial indicia of a bat. The flexible sheet is shaped to simulate bat wings and is attached to the bag. A plurality of closure or bunching means for the flexible bag are provided to cause ear-like protrusions at be formed at the initially open end of the bag member. A plurality of fastener means are provided for fastening the bag and the wing-like sheet together.

20 Claims, 9 Drawing Sheets

U.S. PATENT DOCUMENTS

| | | | |
|---|---|---|---|
| 824,071 | 6/1906 | Faber et al. . | |
| 850,672 | 4/1907 | Novak . | |
| 1,106,353 | 8/1914 | Ademec . | |
| 1,237,930 | 8/1917 | Malvern et al. . | |
| 1,287,154 | 12/1918 | Wells . | |
| 1,308,432 | 7/1919 | Lochridge . | |
| 1,413,978 | 4/1922 | Franklin | 446/226 X |
| 1,536,816 | 5/1925 | Sale . | |
| 1,600,749 | 9/1926 | Barnes . | |
| 1,649,770 | 11/1927 | Miller . | |
| 1,698,653 | 1/1929 | Poole . | |
| 1,950,539 | 3/1934 | Brownfield . | |
| 1,965,040 | 7/1934 | Kelly . | |
| 2,008,552 | 7/1935 | Jacobs . | |
| 2,112,477 | 3/1938 | Brownfield . | |
| 2,208,445 | 7/1940 | Bates . | |
| 2,460,963 | 2/1949 | Young . | |
| 2,689,424 | 9/1954 | Clagett . | |
| 3,026,648 | 3/1962 | Lemelson | 446/226 |
| 3,163,418 | 12/1964 | Myers . | |
| 3,195,265 | 7/1965 | Marquez et al. . | |
| 3,308,936 | 3/1967 | Roland et al. . | |
| 3,349,991 | 10/1967 | Kessler . | |
| 3,442,043 | 5/1969 | Panzer . | |
| 3,626,634 | 12/1971 | Jones et al. . | |
| 3,650,298 | 3/1972 | Delmar . | |
| 3,670,440 | 6/1972 | Yost . | |
| 4,197,983 | 4/1980 | Raudys et al. . | |
| 4,239,825 | 12/1980 | Karlfuss et al. | 428/16 |
| 4,436,204 | 3/1984 | Sowinski . | |
| 4,445,230 | 4/1984 | Spadaro . | |
| 4,495,230 | 1/1985 | Ellwein | 428/13 |
| 4,715,840 | 12/1987 | Swift | 446/74 |
| 4,746,226 | 5/1988 | von Schuckmann . | |
| 4,795,033 | 1/1989 | Duffy . | |
| 5,027,457 | 7/1991 | Sweet . | |

BAT-LIKE DECORATIVE OBJECT

This is a continuation-in-part of Ser. Nos. 07/554,967, field Jul. 18, 1990, 07/664,023, filed Mar. 4, 1991, 07/664,024, filed Mar. 4, 1991, 07/749,263, filed Aug. 23, 1991 and 07/749,165 filed Aug. 21, 1991 and now as U.S. Pat. Nos. 5,195,638 which are hereby incorporated by reference in their entireties herein.

BACKGROUND OF THE INVENTION

This invention relates to decorative objects. More particularly, the invention relates to a combination of a specially produced otherwise common materials which when arranged in appropriate juxtaposition, decoratively simulates or represents a fanciful image or conception of the appearance of a giant bat.

At certain times of the year, such as during late fall, decorative objects are very popular. It is not uncommon to see two-dimensional pictures of witches, goblins, bats, jack-o'-lanterns, etc. pasted in windows or on walls. While three dimensional representative objects are less common than the pictures, some three dimensional objects such as heavy plastic jack-o'-lanterns are known in the art. However, until recently, when a new type of leaf bag (the details of which are disclosed in the parent application hereto, Ser. No. 07/554,967) was sold during the Halloween season to represent or simulate a jack-o'-lantern, thin plastic leaf- or garbage-type bags were not used for three dimensional decorative purposes. Indeed, leaf bags of the prior art were never used in conjunction with other common articles such as spread clips, golf tees, etc., and indicia indicative of the universal image or conception of an object were never printed or placed on plastic leaf bags. Further, common leaf bags were never used in conjunction with other common articles and indicia to represent a flying bat.

SUMMARY OF THE INVENTION

It is therefore an object of the present invention to provide a combination of objects, including a leaf-type bag having appropriate indicia and coloration, which when assembled simulates a giant bat.

It is another object of the invention is to provide a simple, easy-to-manufacture, easy-to-assemble combination of objects for decorative use either indoors or outdoors as desired to simulate s giant bat.

It is a further object of the invention to provide a combination of objects, including a leaf-type bag and a sheet of thin plastic, which when hung or supported simulates a flying giant bat.

In accordance with the objects of the present invention a combination of components is provided for simulating a giant bat. The components of the combination include a plastic bag representing the head and body of a giant bat, a plurality of light-weight filler elements which are intended for insertion into the plastic bag and which are preferably flexible, deformable, and inflatable, a bat wing-like flexible plastic sheet, connection means for connecting the wing-like flexible plastic sheet to the plastic bag, and bunching means for closing the open end of the plastic bag over the light-weight filler elements so as to form ear-like protrusions. Preferably, means for supporting the wing-like member in an extended configuration are provided. Also, preferably, the plastic bag is provided with facial indicia such as mouth, fangs, and eyes which represent the fanciful face of a bat, and the plastic bag has a presealed end and an initially open opposite end into which the inflated filling elements are inserted. The presealed end of each bag is arranged such that the bag assumes a generally cylindrical shape with a rounded closed end when the bag member is substantially filled with inflatable filler elements material. The bat wing-like plastic sheet is suitably of the same type of plastic and color as that of the bag member and is attached at a predetermined location to the bag member.

The plastic bag and wing-like members are preferably made of thin flexible plastic material such as the material from which plastic leaf or garbage bags are made, and at least the major portion of the outside surface of the bag assembly is black to simulate the exterior of a bat. The indicia representing the artificially, fanciful face of a bat are preferably located adjacent the open end of the bag. The inflatable flexible filler elements are preferably balloons. Because the combination of objects used to simulate the giant bat are extremely lightweight, the inflatable filler elements need not have lift; i.e., helium balloons are not required, provided support means are provided if the decorative bat is to appear to fly. The combination of elements provides a decorative simulation of a giant bat which can be erected outdoors and also indoors with the wing-like member being supported in an extended position.

In a particular embodiment of the invention, a kit is provided from which the decorative combination of the present invention can be completely assembled to simulate a giant bat.

Additional objects and advantages of the invention will become apparent to those skilled in the art upon reference to the detailed description in conjunction with the accompanying drawings.

DETAILED DESCRIPTION OF INVENTION

Figure 1:
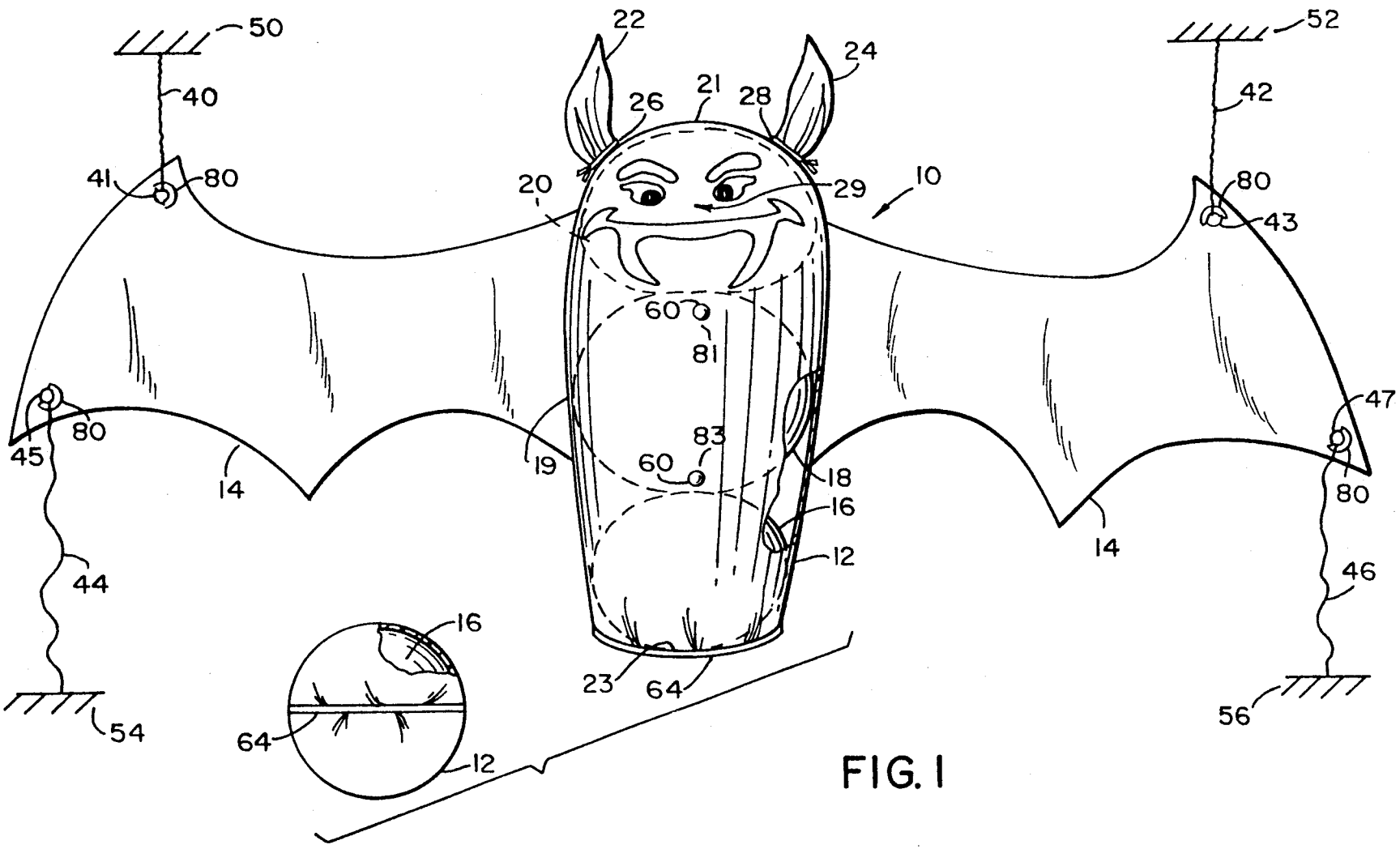
FIG. 1 is a front elevation view showing an embodiment of the decorative combination of the present invention simulating a giant bat.

With reference to FIG. 1, a decorative combination simulating a giant bat is indicated at 10, and comprises a bag 12, a simulated bat wing member 14, a plurality of light-weight inflated filler elements 16, 18, 20 enclosed within bag 12, and bag closure means 26, 28. The inflated filler elements 16, 18, and 20 when enclosed within bag 12 establish a generally cylindrical intermediate bag portion 19 and generally rounded opposed end portions 21, 23. The bag member 12 has gathered earlike protrusions 22, 24 held in place by closure means 26, 28 and is provided with fanciful bat-like facial indicia 29. The bag 12, except for the aforementioned indicia, is shown with a plain outer surface which is black to simulate the outer surface of a bat. The bat wing member 14 can be supported in an extended position, for example by means of strings, cords, twist-ties, or other similar elements 40, 42, 44, 46 which engage preformed openings 41, 43, 45, 47 in wing-like member 14. As seen in FIG. 1, strings 40, 42 are suitably coupled to overhead supports 50, 52 which can be tree branches or a ceiling, while strings or cords 44, 46 are suitably connected loosely to base supports 54, 56 (floor, ground, lower branches) to permit a wind or breeze to impart hovering or floating flight-like motion to the giant bat 10, of course, depending upon the desired position to be assumed by the giant bat 10, strings 44, 46 can also be coupled to overhead supports.

Figure 2A:
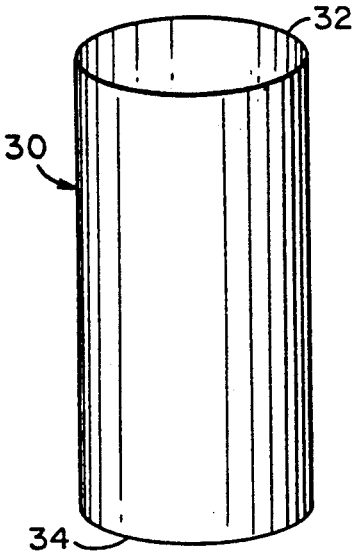
FIGS. 2(A)–2(F) are perspective views of flexible bags that can be used in the decorative combination of the present invention.
Figure 2B:
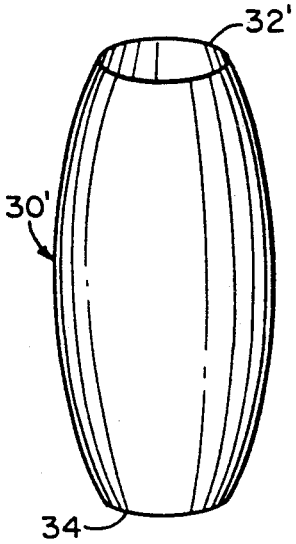
Figure 2C:
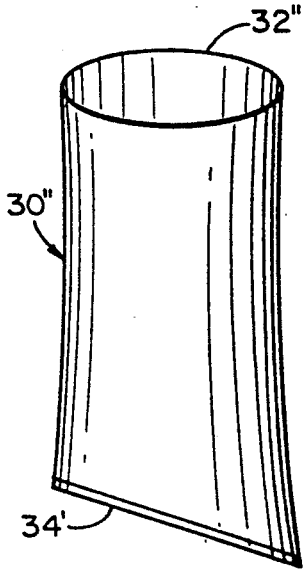
Figure 2D:
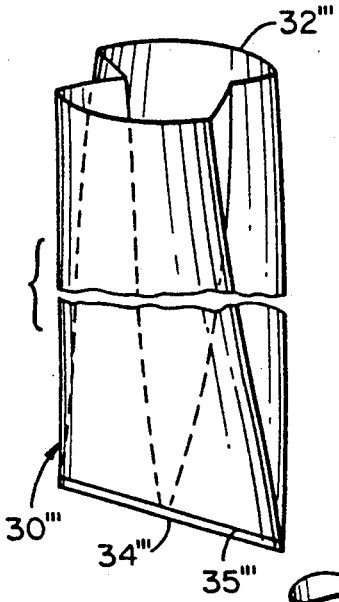

Bag 12 can be made in various suitable colorations from any of numerous flexible bag types, examples of which are shown in FIGS. 2(A)–(E). For example, FIG. 2(A) shows a tubular bag 30 formed in a substantially cylindrical shape from a flexible, water-resistant plastic material, for example, of the type conventionally used for trash or leaf bags. Alternatively, the bag material can be any other type of plastic film-type material, paper, woven or non-woven fabric or any other suitable thin, flexible, film-type material. The outer surface of the tubular bag 30 is preferably black to represent the outer surface of a bat. Although bag 30 is shown having a cylindrical tubular configuration with first and second ends 32 and 34, the bag may have any other suitable configuration within the scope of the present invention. For example, a convex cylindrical configuration bag 30' is shown in FIG. 2(B). Bag 30' has first and second ends 32' and 34'. Alternatively, and as shown in FIG. 2(C), a conventionally shaped leaf or trash bag 30'' having an open end 32'' and a closed bottom end 34'' can be used. As shown in FIG. 2(C), the closed bottom end 34'' is closed by heat sealing. As a still further alternative, a conventional gussetted bag 30''' as shown in FIG. 2(D) can be used. Gussetted bag 30''' has a closed bottom end 34''' and an open top end 32'''. With the gussetted bag 30''', the opposed bottom sides of the bag are each drawn inwardly into the bag and secured to the overlapping bottom portion to form gussets in a conventional manner, as shown at 35'''. In any case, bag 30 has an upper open end 32 and a lower end 34 which may be open as shown in FIGS. 2(A) and 2(B) or which may be closed as shown in FIGS. 2(C) and 2(D).

Figure 2E:
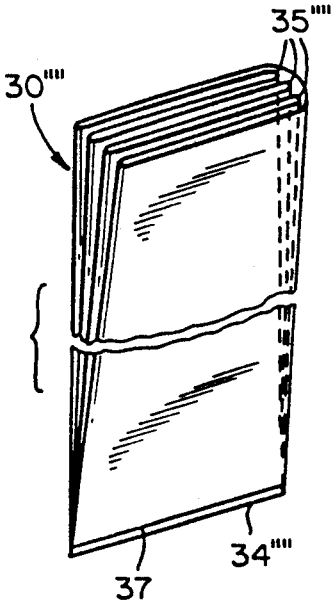
Figure 2F:
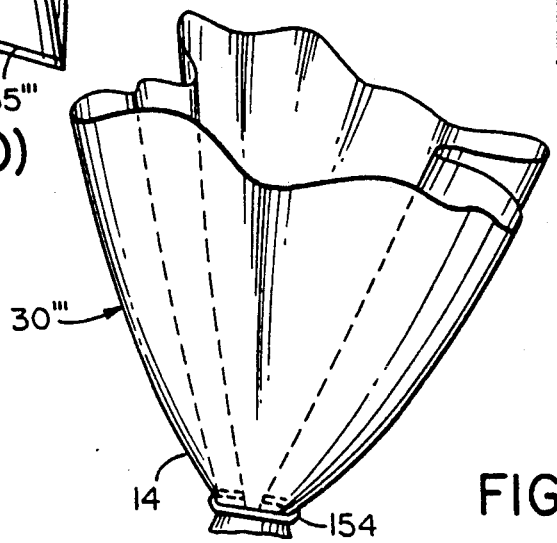

As shown in FIG. 2(E), when using a bag 30'''' having a closed bottom end 34'''' with a so-called Z-lock construction, the lower portion of the bag provides a limited bunching effect when it is filled. A "Z-lock" bag is a commercially available bag and can be considered as a modified gussetted bag. Specifically, with a Z-lock bag, as shown in FIG. 2(E), gussets 35'''' are formed along the length of the Z-lock bag, preferably with the innermost portions of the side gussets 35'''' meeting around the middle of the bag. Then, the bag is folded in half over itself, and secured in such position by heat sealing or the like to provide a heat seal 37 at the bottom 34'''' of the bag. The securing of the bag in such a position can be made by a conventional heat seal 37 or the like along the bottom of the bag. In this sense, bottom end 34'''' of bag 30'''' is provided with a limited bunching effect.

Figure 3:
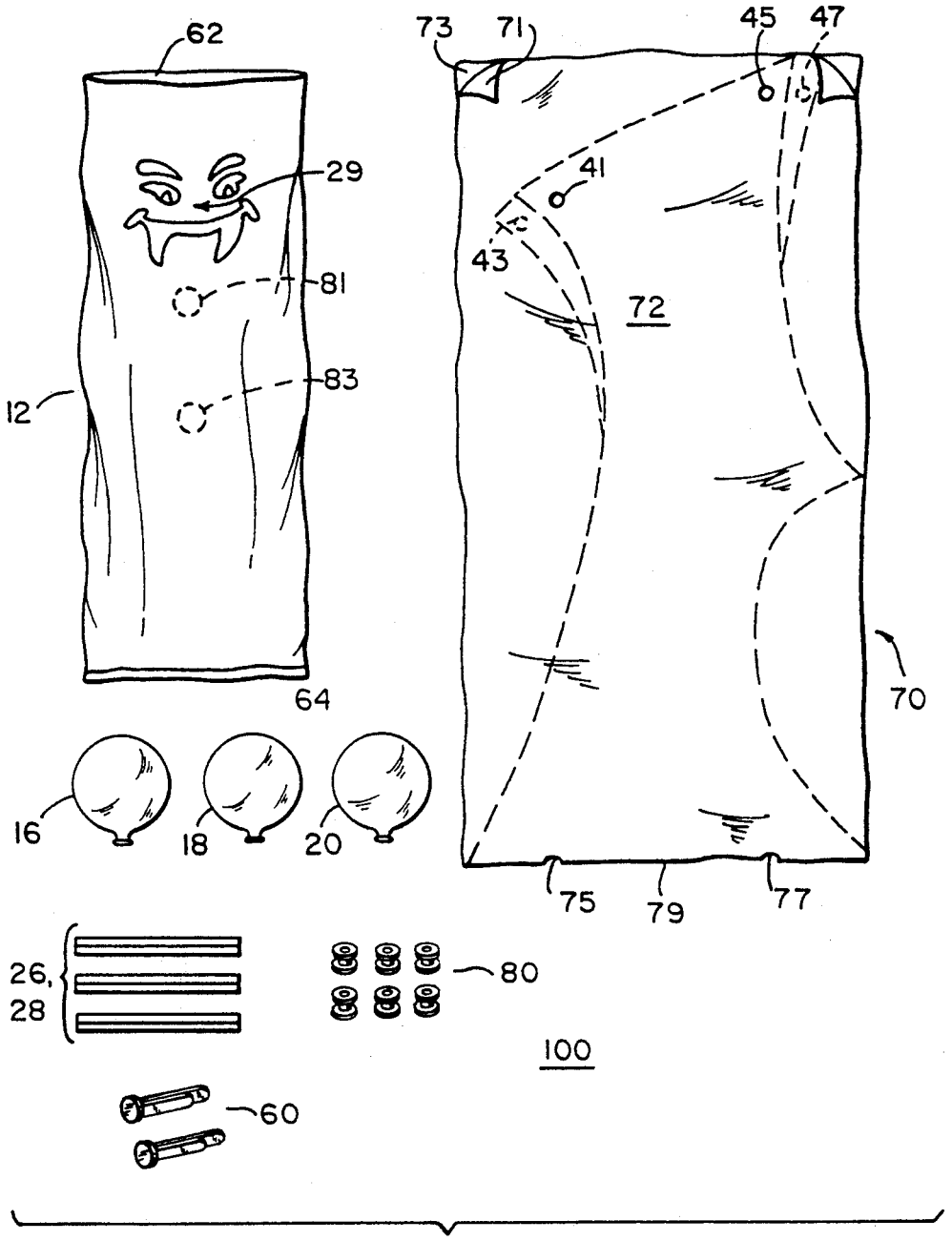
FIG. 3 illustrates a kit from which a combination in accordance with the present invention can be assembled.

A kit 100 for the giant bat combination of FIG. 1 is shown in FIG. 3 and comprises a flexible bag member 12, a sheet of flexible material 70, a plurality of closure or bunching means such as ties 26, 28, a plurality of first fastener means such as spread clips 60 and a plurality of light-weight inflatable, flexibly deformable means such as elastic, "blowup" balloons 16,. 18, 20. The bag and the sheet 70 are typically black at their outer surface to simulate the coloration of a bat, and white or gray bat-like facial indicia 29 can be provided separately (with an adhesive surface) or printed on the bag 12. Bag member 12 also preferably has a closed end 64 which is suitably heat sealed. Open end 62 is closed by a bunching means 26, 28 after the bag member has been suitably filled with inflated balloons 16, 18, 20 as hereinafter described.

The sheet of flexible material 70 is preferably folded over such that it has two panels 71, 73. The sheet 70 is suitably made of the same material as that of bag member 12, and is provided with an outline of a bat wing indicated at 72. Sheet 70 may also be provided with printing to simulate the bony structure of a bat wing. When sheet 70 is cut along outline 72, the resulting configuration is the symmetrical bat wing-like strip 14 shown in FIG. 1 and FIG. 2C. Precut holes 41, 45 and 43, 47 are preferably provided in the respective panels 71, 73 near what will become the corners of the bat wing when cut. If the precut holes are not provided, holes must eventually be made in the panels 71, 73 so that the giant bat combination can be supported in air as hereinafter described. Additional precut holes 75, 77 are also preferably provided (although they too can be made upon assembly) in the sheet 70 at the middle fold 79 thereof for permitting the sheet 70 to be easily attached to bag 12. Reinforcement elements for the precut holes are shown at 80 in the form of small plastic or paper reinforcers. Fastener means such as spread clips 60 or twist ties (shown in FIG. 4A) are preferably used for attaching the wing-like member 14 through precut holes 75, 77 to bag member 12 at locations 81, 83 on the side of the bag opposite the indicia 29.

Figure 4A:
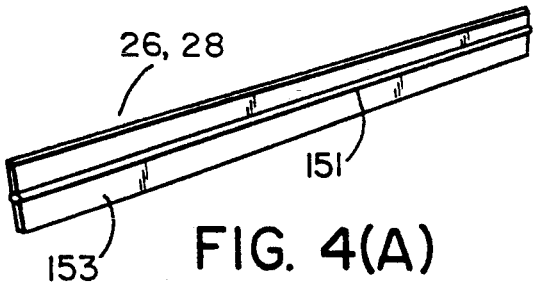
FIGS. 4(A)–4(B) show different closure means for use in the present invention.
Figure 4B:
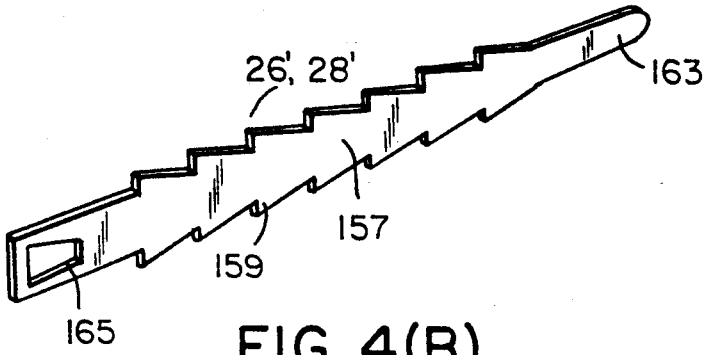

FIG. 4A shows the twist ties 26/28 of FIG. 3 and FIG. 4B shows a suitable alternate bunching means 26'/28'. The typical tie 26/28, noted above and shown in FIG. 4(A) comprises a flexible wire 151 embedded in flexible (preferably black) plastic 153, as is conventional. An alternate bunching means is shown at 26'/28'in FIG. 4(B) formed of flexible plastic strap 157 (also preferably either uncolored—clear, or colored black) with barbs 159 which engage the strap when the tapered end thereof 163 is threaded through opening 165. This type of bunching means is commercially available. These illustrations are shown only by way of example, and other ties or bunching means can be used.

Figure 5A:
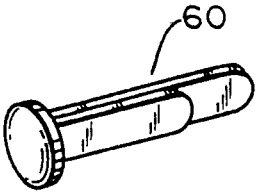
FIGS. 5(A)–5(D) illustrate details for securing of the components of the combination of the present invention.
Figure 5B:
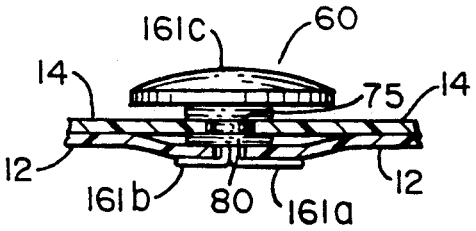
Figure 5C:
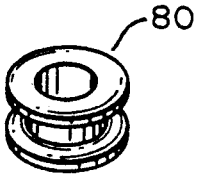
Figure 5D:
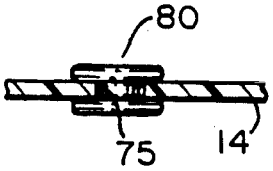

FIG. 5A shows a spread clip 60 which can be used in conjunction with hole reinforcement elements 80 of FIG. 5C in securing flexible plastic sheets together. In particular, as shown in FIG. 5D, a hole reinforcement element 80 which is generally spool-shaped is used to reinforce a hole the plastic sheet 14 by slipping one end of the spool through the hole. Then as shown in FIG. 5B, the plastic sheet 14 with reinforcing element 80 is placed adjacent the plastic bag 12, and the sharp end of spread clip 60. is inserted through the reinforcement element 80 and pushed through plastic bag 12. The ends of the clip 161*a*, 161*b* are then spread (bent) to hold the clip and hence the bags in place, with the head of the clip 161*c* atop the reinforcing element 80.

Figure 6A:
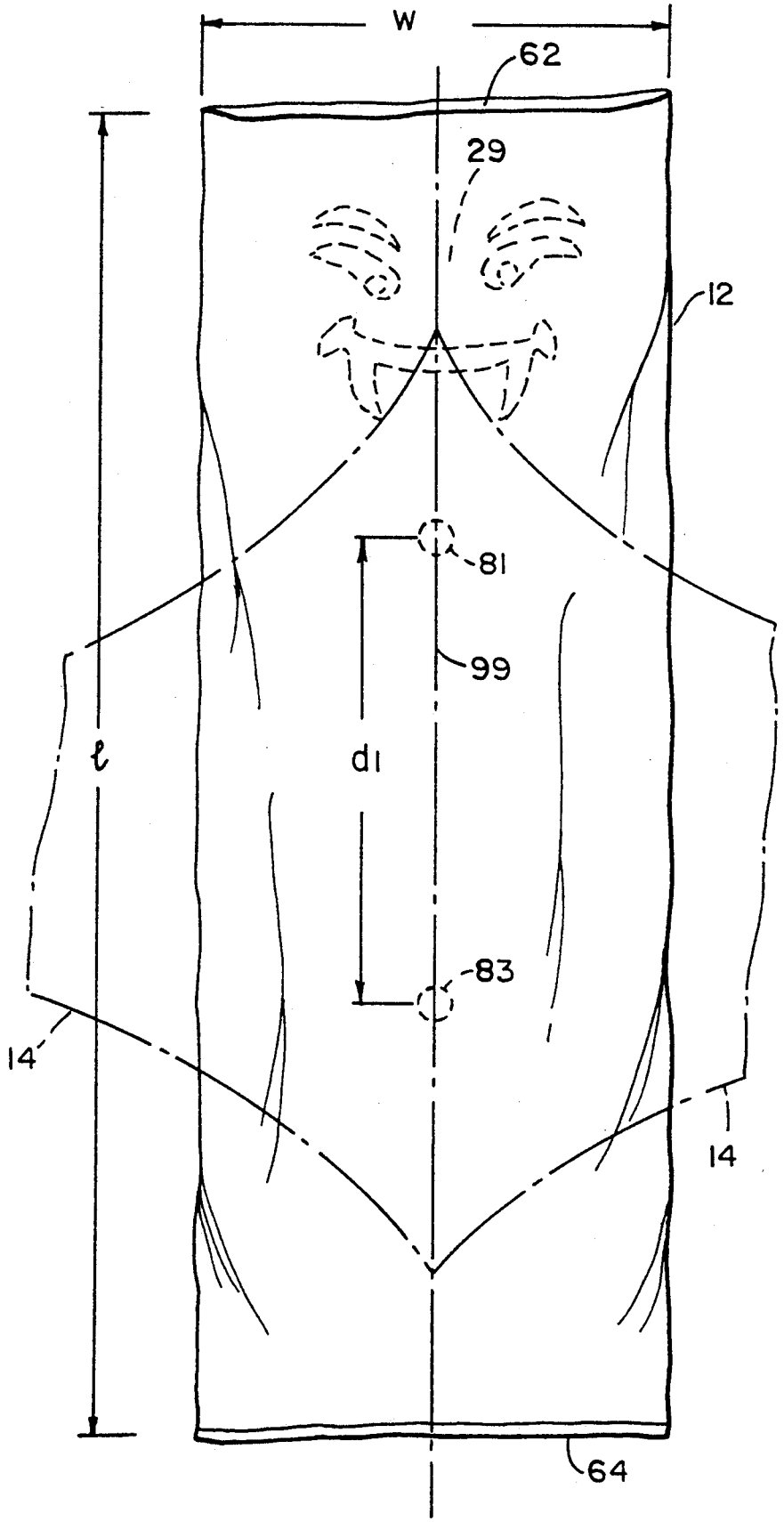
FIGS. 6(A)–6(E) show details of the assembly of the combination of the present invention.
Figure 6B:
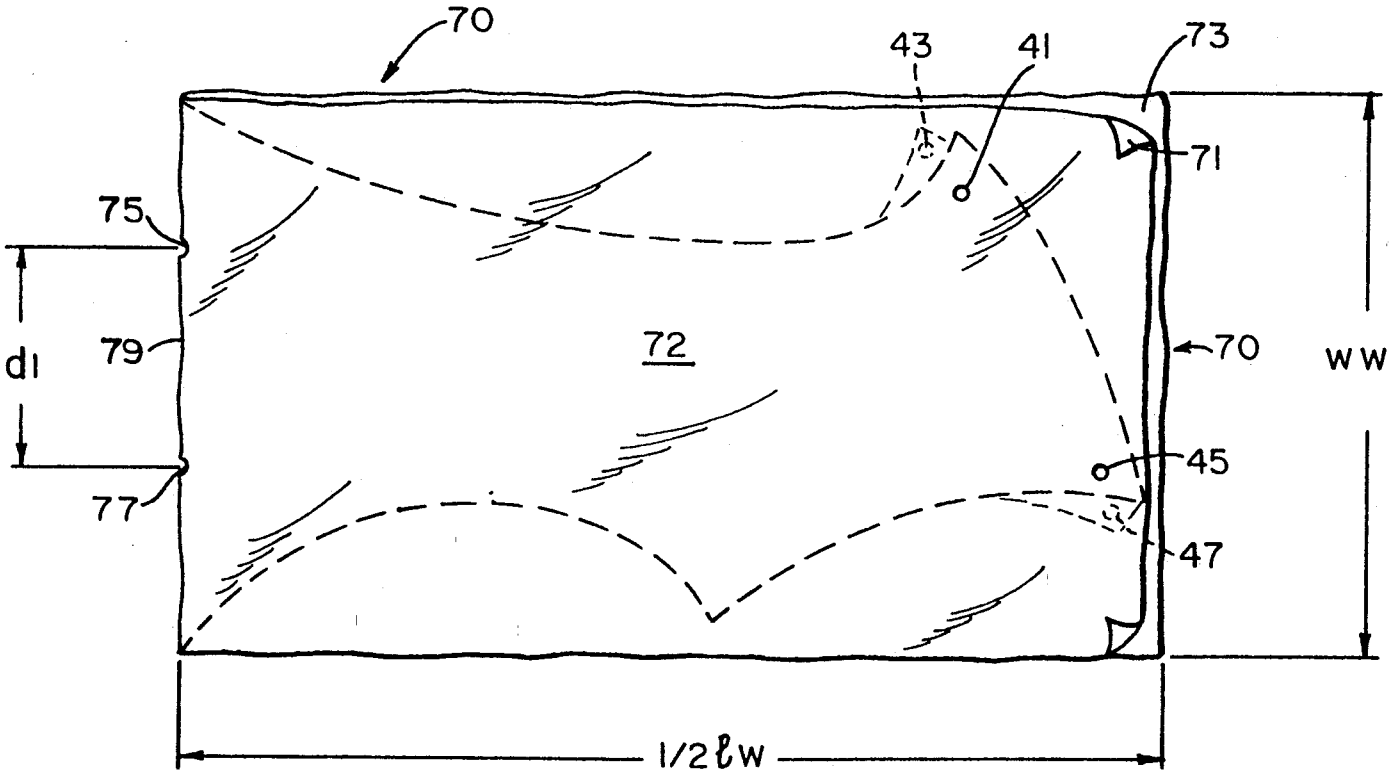

With reference to FIG. 6A, in the preferred embodiment of the present invention, a flexible, generally sleeve-shaped, bag 12 of the type hereinbefore described of about 3–4 feet in length (l) and about 1–2 feet in width (w) is used. The flexible bag 12 is closed at one end by a heat seal 64 and initially has an open opposite end 62. Positioning indicia 81, 83 are marked or fixed to the outer surface of bag 12 on the side of the bag opposite to the bat facial indicia 29 (shown also in FIG. 6D). Positioning indicia 81, 83 which are preferably located in the middle portion 19 of bag member 12, are aligned with the longitudinal axis 99 of bag 12 and are spaced apart by the distance d1 which is the same as the spacing between the central through holes 75, 77 of sheet 70 as shown in FIG. 6B. With reference to FIG. 6B, sheet 70 is preferably provided with a bat wing outline 72, suitably printed or placed on a surface of sheet 70. The outline is provided to permit sheet 70 to be cut, using scissors, shears or the like to obtain the unfolded bat wing shape 14 shown in FIG. 6C. The bat wing shape, when unfolded, is preferably nine to eleven feet in length and approximately three feet wide; i.e., the folded length (½ lw) is four and a half to five an a half feet long, while the width (ww) remains the same. Of course, it will be appreciated that the sheet 70 can be precut if desired, and can be provided with a different shaped outline if desired. In addition, different sized wings can be used.

Figure 6C:
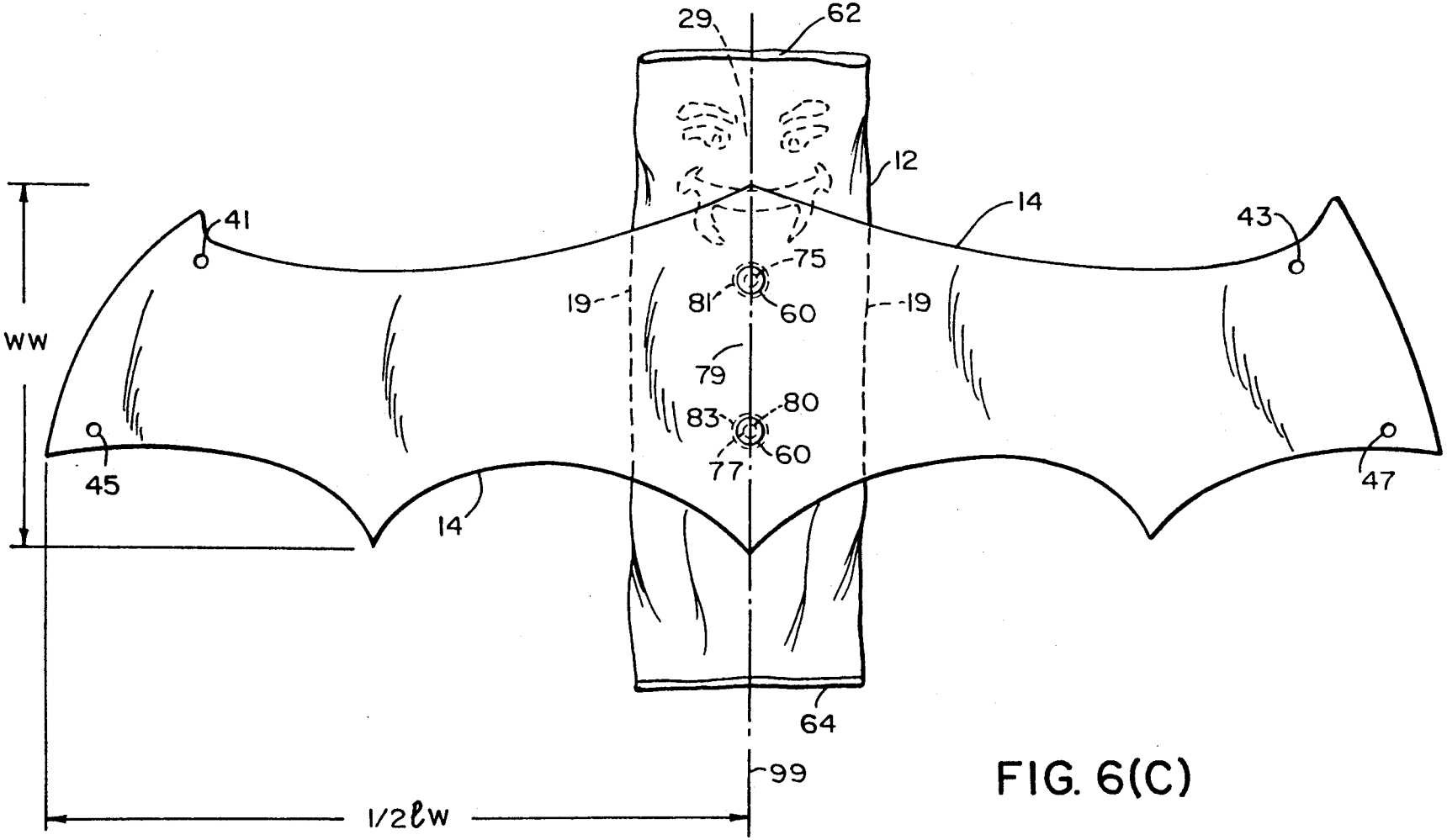
Figure 6D:
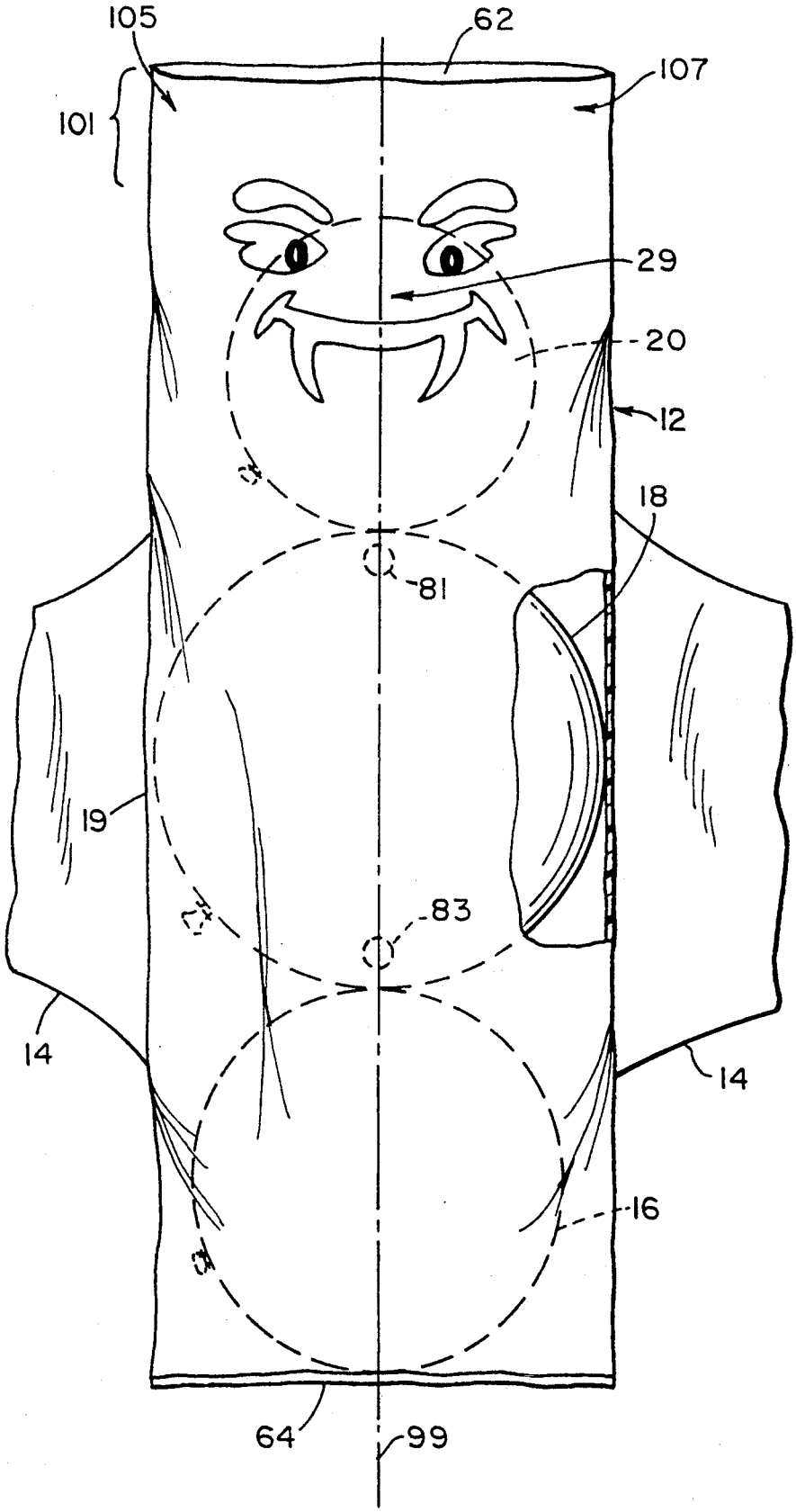

With reference to FIG. 6C, in assembling the bat-like object of the invention, the cut bat wing member 14 is unfolded, and if desired, hole reinforcement elements 80 may be inserted in some or all of the precut holes 41, 43, 45, 47, 75, 77. The precut holes 75, 77 of the bat wing member 14 on central fold 79 (with or without reinforcement elements 80) are then placed in register with positioning indicia 81, 83 on the outer surface of bag member 12. The bat wing is then affixed to the bag member using spread clips 60 as illustrated in FIG. 5B. If desired, one or more pieces of double sided tape or heavy duty staples may be used as connecting members in place of providing holes 75, 77 and spread clips 60. With the bat wing flexible strip 14 attached to bag member 12, inflatable filler elements 16, 18, 20, e.g. "blowup" type balloons, are inflated and inserted in an abutting tandem array as shown in FIG. 6D. At least one of the inflated elements (preferably the one 18 located in the intermediate position 19 of bag member 12) should fit closely within the bag member 12. The other inflated elements 16, 20 can be inflated to a lesser size to allow a tapering effect when the bag is closed. Alternatively, the inflated elements 16, 18, 20 can all be inflated to substantially the same size. As another alternative, light-weight filler elements such as styrofoam balls, styrofoam "peanuts", or other light-weight fillers such as crumpled newspaper may be used. In any event, after being placed in a tandem abutting array substantially in alignment with the longitudinal axis 99 of the bag member 12, an unfilled end portion 101 at open end 62 of bag member 12 should remain. The unfilled end portion 101 can be defined as having two opposed portions 105, 107 on opposite sides of longitudinal axis 99.

Figure 6E:
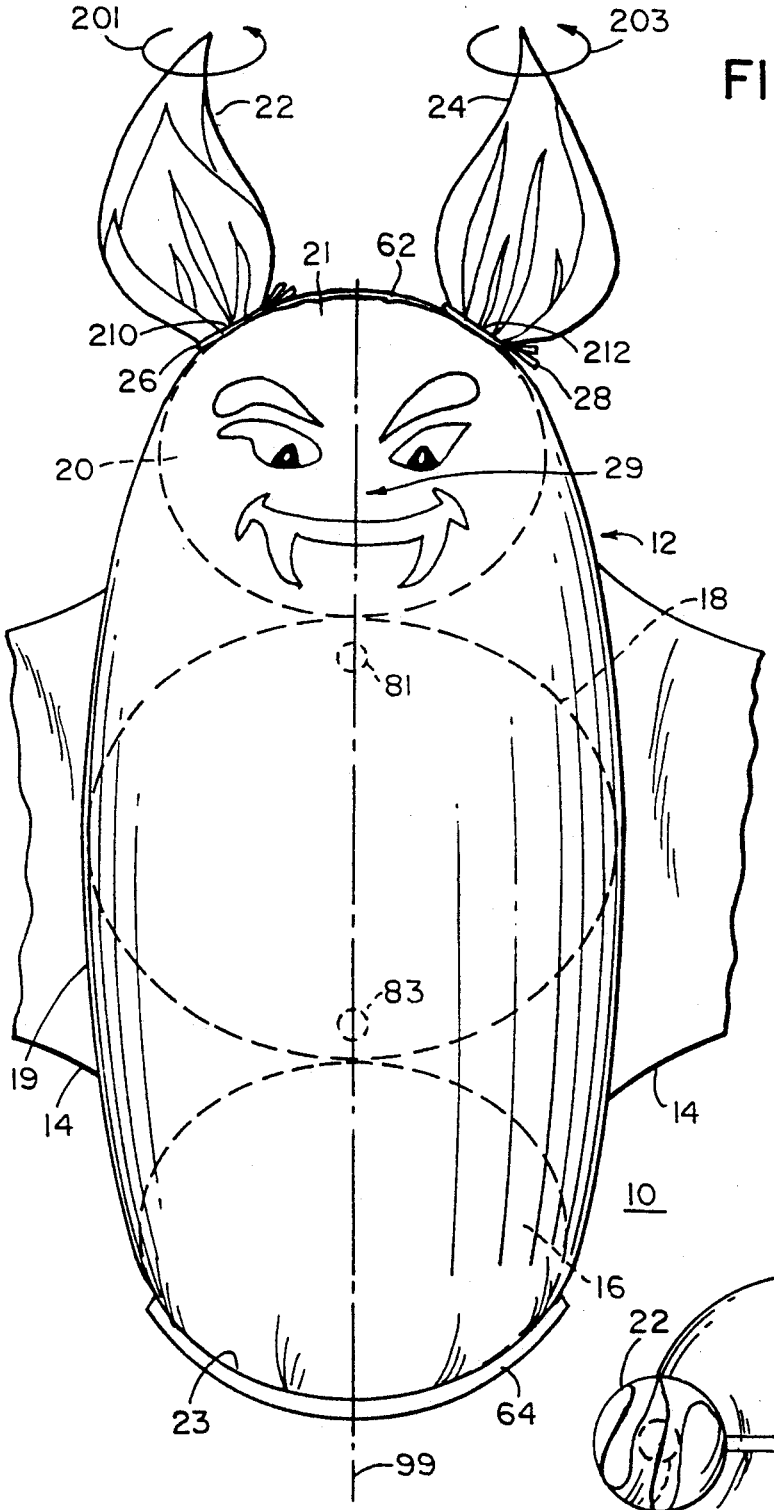
Figure 6F:
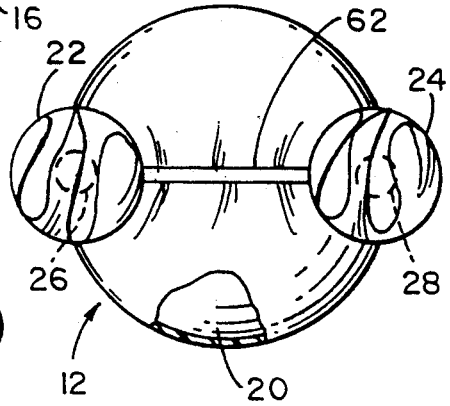
FIG. 6(F) shows a top view of FIG. 6(E).

Turning to FIG. 6E, with the light-weight filler elements 16, 18, 20 within bag member 12 as above-described, opposed portions 105, 107 of bag member 12 are respectively gathered to form protrusions, gathers, or flares 22, 24. The gathering of opposed portions 22, 24 is preferably accomplished so that the open end 62 of bag member 12 is virtually closed, as shown in FIG. 6F. With the open end 62 of bag member 12 closed, the inflated elements 16, 18, 20 are forced together along longitudinal axis 99 and are flexibly deformed so as to be conformable with the sleevelike bag member 12 at its opposite ends 21, 23 and intermediate portion 19. In this manner, the opposite ends 21, 23 of bag 12 are generally rounded, and intermediate portion 19 of bag 12 is substantially cylindrical and tubular. The foregoing gathering of portions 22, 24 is enhanced by twisting as indicated at 201, 203 in FIG. 6E which makes protrusions 22, 24 more ear-like in appearance and enables gradual deformation of inflatable elements 16, 181 20 and tightening and closing of open end 62 to establish the abovedescribed conformable arrangement of bag member 12 and inflated elements 16, 18, 20. If desired, prestamped holes (not shown) may be provided on opposite sides of bag member 12 near open end 62 to permit use of a spread clip 60 or the like to additionally secure the closure of opening 62. Alternatively, tape, or other closure means can be utilized if desired.

When the desired degree of deformation of inflated elements 16, 18, 20 is achieved, closure means 26, 28 e.g. twist ties, are applied at the respective portions 210, 212, of bag material protrusions 26, 28 contiguously adjacent to inflated element 16 so that the deformation of the inflated members 16, 18, 20 and hence the conformable rounded ends 21, 23 and cylindrical tubular intermediate portion 19 of bag member 12 are maintained.

With the assembly of the combination completed the giant bat 10 can be arranged as shown in FIG. 1 and described hereinabove.

There has been illustrated and described herein a decorative bat-like assembly and kit. While particular embodiments of the invention have been described, it is not intended that the invention be limited thereto, as it is intended that the invention be as broad in scope as the art will allow and that the specification be read likewise. Thus, while particular closure means and fastening means were disclosed, it will be appreciated that other mechanisms could be utilized. For example, rather than using twist-ties or barbed plastic straps, rubber bands could be utilized for the closure means. Similarly, instead of spread clips, other fastening means could be utilized such as yarn (where two sets of two adjacent holes are provided on the wings and bag), twist-ties, staples, two-sided tape, etc. Also, while three generally round balloons were described for use as filling the bag member, it will be appreciated that different numbers and/or shapes of balloons, or different light-weight filling elements could be utilized. Further, while the disclosed bat-like assembly was disclosed as being made of certain materials and having a certain shape, it will be appreciated that other materials and shapes can be utilized, provided a lightweight decorative assembly having the appearance of an oversized fanciful bat is accomplished. It will therefore be appreciated by those skilled in the art that yet other modifications could be made to the provided invention without deviating from its spirit and scope as so claimed.

What is claimed is:

1. Decorative bag and sheet assembly stimulating a bat comprising:

a) a generally sleeve-shaped bag member made of thin flexible material, said bag member having a longitudinal axis and at least one open end, and having an outer surface which is mostly black to simulate the body of a large bat;

b) at least one light-weight filler means for placement within said bag member, said filler means sized to fill all but a longitudinally extending terminal portion of said bag member;

c) at least one closure means for substantially closing said at least one open end of said bag member at said longitudinally extending terminal portion, wherein said bag member assumes a generally tubular shape after said bag member is substantially filled with said at least one light-weight filler means;

d) a sheet of flexible material shaped to simulate a bat wing configuration, said sheet of flexible material attached to said generally sleeve-shaped bag member; and e) a plurality of bendable spread clips attaching said sheet of flexible material to said bag member, wherein said bag member assumes a generally tubular shape, and said sheet of flexible material attached to said bag member by said plurality of bendable spread clips together with said bag member provides a decorative object which simulates a giant bat.

2. A decorative bag and sheet assembly according to claim 1, wherein:

said bag member has indicia simulating a fanciful face of a bat with a mouth, fangs and eyes.

3. A decorative bag and sheet assembly according to claim 2, wherein:

said bag member has a presealed end opposite said open end.

4. A decorative bag and sheet assembly according to claim 1, further comprising:

e) a plurality of connecting means extending through said sheet of flexible material and through said bag member for connecting said sheet to said bag member.

5. A decorative bag and sheet assembly comprising:

a) a generally sleeve-shaped bag member made of thin flexible material, said bag member having a longitudinal axis and at last one open end, and having an outer surface which is mostly black to simulate the body of a large bat;

b) at least one light-weight filler means for placement within said bag member, said filler means sized to fill all but a longitudinally extending terminal portion of said bag member;

c) at least one closure means for substantially closing said at least one open end of said bag member at said longitudinally extending terminal portion, wherein said bag member assumes a generally tubular shape after said bag member is substantially filled with said at least one light-weight filler means; and d) a sheet of flexible material shaped to simulate a bat wing configuration, said sheet of flexible material attached to said generally sleeve-shaped bag member, wherein said bag member, when assuming a generally tubular shape, and said sheet of flexible material when attached to said bag member provide a decorative object which simulates a giant bat, wherein said at least one closure means comprises two closure means for gathering opposed portions of said longitudinally extending terminal portion into respective bat ear-resembling gathered protrusions.

6. A decorative bag and sheet assembly according to claim 5, wherein:

said at least one light-weight filler means comprises a plurality of inflatable balloons.

7. A decorative bag and sheet assembly according to claim 6, wherein:

said bag member has indicia simulating a fanciful face of a bat with a mouth, fangs and eyes, and said indicia are positioned on said bag member substantially adjacent said gathered protrusions.

8. A decorative bag and sheet assembly according to claim 7, wherein:

said gathered protrusions are twisted to cause said at least one open end of the bag member to be substantially closed and said balloons to be flexibly deformed to establish substantially rounded opposite end portions of said bag member, said bag member has a presealed end opposite said open end, and said sheet of flexible material has at least four holes through which means for supporting said bat like decorative bag and sheet assembly are extended.

9. A decorative bag and sheet assembly according to claim 8, further Comprising:

e) a plurality of connecting means extending through said sheet of flexible material and through said bag member for connecting said sheet to said bag member.

10. A decorative bag and sheet assembly according to claim 5, wherein:

said gathered protrusions are twisted to cause said open end of the bag member to be substantially closed and said at least one light-weight filler means to be flexibly deformed to establish substantially rounded opposite end portions of said bag member.

11. A kit for forming a decorative combination structure simulating a fanciful conception of the appearance of a giant bat, comprising:

a) a flexible bag having an open end for receiving at least one light-weight filler element, said flexible bag with said at least one light-weight filler element simulating the appearance of a giant bat body;

b) at least one light-weight element;

c) at least two bunching means for gathering together separate opposed portions of said flexible bag at said open end of said bag and for thereby substantially closing said open end of said bag in two separate opposed places in order to simulate bat ears after said at least one light-weight filler element is inserted in said bag;

d) a flexible sheet either precut to simulate the appearance of bat wings, or having on its surface the outline of at least one bat wing; and e) at least one connecting means for connecting said flexible sheet to said bag.

12. A kit according to claim 11, wherein:

said at least one connecting means comprises a plurality of bendable spread clips.

13. A kit according to claim 11, wherein:

said bag has an outside surface substantially all black in color except for bat face indicia which are printed on said bag.

14. A kit according to claim 11, wherein:

said bag has an outside surface substantially all black in color, and said kit further includes facial indicia means for attaching to said outside surface.

15. A kit according to claim 11, wherein:

said bag includes placement indicia means on an outer surface of said bag for indicating a predetermined position for attachment of said flexible sheet to said bag member, and said flexible sheet includes a plurality of precut attachment holes for overlying said placement indicia means.

16. A kit according to claim 11, wherein:

said flexible sheet is provided with a plurality of precut support holes.

17. A kit according to claim 16, further comprising:

a plurality of supporting means for engaging said support holes of said flexible sheet.

18. A kit according to claim 11, wherein:

said at least one light-weight filler element comprises at least one inflatable element.

19. A kit according to claim 18, wherein:

said at least one connecting means comprises a plurality of bendable spread clips, said bag has an outside surface substantially all black in color except for bat face indicia which are either printed on said bag or separately provided for attachment to said outside surface, and said bag includes placement indicia means on said outside surface of said bag member opposite said bat face indicia for indicating a predetermined position for attachment of said flexible sheet to said bag, and said flexible sheet includes a plurality of precut attachment holes for overlying said placement indicia means.

20. A kit according to claim 19, further comprising:

a plurality of supporting means for engaging a plurality of precut support holes, wherein said flexible sheet is provided with a plurality of precut support holes for engagement with said supporting means.

* * * * *